United States Patent [19]

Yoshinaga et al.

[11] Patent Number: 4,534,920

[45] Date of Patent: Aug. 13, 1985

[54] PROCESS FOR PRODUCING CARBONIZABLE OXIDIZED FIBERS AND CARBON FIBERS

[75] Inventors: Minoru Yoshinaga; Nobuyuki Matsubara; Ryuichi Yamamoto, all of Ehime, Japan

[73] Assignee: Toray Industries, Inc., Tokyo, Japan

[21] Appl. No.: 501,911

[22] Filed: Jun. 7, 1983

[30] Foreign Application Priority Data

Jun. 7, 1982 [JP] Japan ..... 57-96303

[51] Int. Cl.[3] ..... D01F 9/22

[52] U.S. Cl. ..... 264/29.2; 264/29.4; 264/29.6; 264/29.7; 423/447.6; 423/447.8

[58] Field of Search ..... 264/29.2, 29.4, 29.6, 264/29.7, 28; 423/447.6, 447.8

[56] References Cited

U.S. PATENT DOCUMENTS

| | | | |
|---|---|---|---|
| 3,673,035 | 6/1972 | Whitney | 264/29.7 |
| 3,935,301 | 1/1976 | Morita et al. | 264/29.2 |
| 4,065,549 | 12/1977 | Kinoshita | 264/29.2 |
| 4,069,297 | 1/1978 | Saito et al. | 423/447.6 |
| 4,100,004 | 7/1978 | Moss et al. | 264/29.2 |
| 4,186,179 | 1/1980 | Katsuki et al. | 264/29.2 |
| 4,314,981 | 2/1982 | Miyamori et al. | 264/29.2 |
| 4,347,279 | 8/1982 | Saji et al. | 423/447.6 |
| 4,389,387 | 6/1983 | Miyamori et al. | 264/29.2 |
| 4,397,831 | 8/1983 | Saito et al. | 423/447.6 |

FOREIGN PATENT DOCUMENTS

| | | | |
|---|---|---|---|
| 2603029 | 8/1977 | Fed. Rep. of Germany | 264/29.2 |
| 50-145620 | 11/1975 | Japan | 264/29.2 |
| 52-74026 | 6/1977 | Japan | 264/29.2 |
| 55-163217 | 12/1980 | Japan | 264/29.2 |
| 58-36216 | 3/1983 | Japan | 264/29.2 |
| 1405891 | 9/1975 | United Kingdom | 264/29.2 |

*Primary Examiner*—Jeffery Thurlow

*Attorney, Agent, or Firm*—Armstrong, Nikaido, Marmelstein & Kubovcik

[57] ABSTRACT

Disclosed is a process for producing carbon fibers comprising providing cooling rollers in a 240° to 400° C. oxidative atmosphere, heating a precursor composed of continuous filaments in said oxidative atmosphere while intermittently and repeatedly bringing the precursor into contact with the cooling rollers to thereby convert the precursor to oxidized fibers and carbonizing the resulting oxidized fibers in an inert atmosphere of at least 800° C.

18 Claims, 2 Drawing Figures

PROCESS FOR PRODUCING CARBONIZABLE OXIDIZED FIBERS AND CARBON FIBERS

BACKGROUND

This invention relates to a process for producing oxidized fibers and carbon fibers and, more particularly, to a process for producing carbon fibers with excellent mechanical properties from oxidized fibers prepared by oxidizing precursor fibers in a shorter time than in a conventional precursor-oxidizing step.

For the industrial production of carbonizable oxidized fibers and carbon fibers, there has been widely employed a process of heating raw fibers or precursor fibers composed of, for example, acrylic fibers, tar pitch or petroleum fibers, rayon fibers or polyvinyl alcohol fibers in an oxidative atmosphere at 200° to 400° C. and further carbonizing the resulting oxidized fibers in an inert atmosphere at least at 800° C. In this process, the step of converting the precursor fibers to oxidized fibers requires an extremely long time. Therefore, an attempt of shortening the time for improving productivity has been made by raising the temperature of the oxidative atmosphere or by rapidly raising the temperature to shorten the time. However, it has resulted in formation of a large amount of pitch or tarry product from the precursor or in adhesion of the single filaments, thus causing deterioration of quality of oxidized fibers. As a result, carbon fibers with excellent mechanical properties have been obtained with difficulty from such deteriorated oxidized fibers. In addition, exothermic heat produced by the precursor is accumulated in the precursor, and hence a so-called run-away reaction takes place and, in the worst case, the precursor fibers can be broken or burnt. This tendency becomes serious in the case the precursor is baked in the form of a thick bundle of more than several-thousand deniers for raising productivity.

SUMMARY

An object of the present invention is to provide a process for producing carbonizable oxidized fibers and carbon fibers which enables the conversion of precursor fibers to oxidized fibers in a short time without causing deterioration of the mechanical properties of the resulting carbon fibers.

Another object of the present invention is to provide a process for producing carbonizable oxidized fibers and carbon fibers which enables the production of oxidized fibers with high energy efficiency by facilitating temperature control of the precursor itself in the oxidative atmosphere.

A further object of the present invention is to provide a process for producing carbonizable oxidized fibers and carbon fibers which enables the conversion of a large amount of precursor fibers to oxidized fibers in a short time without causing adhesion of single filaments.

The above-described objects can be attained by providing cooling means in the oxidative atmosphere of 240° to 400° C., heating a precursor composed of continuous filaments in the oxidative atmosphere while intermittently and repeatedly bringing the precursor into contact with the cooling means to thereby convert the precursor to oxidized fibers, and carbonizing the resulting oxidized fibers in an inert atmosphere of at least 800° C.

In the process of the present invention, intermittent contact of the precursor with the above-described cooling means in the heat treatment of the precursor in an oxidative atmosphere lowers the temperature of the precursor by about 5° to about 30° C. from the temperature before the contact and controls the oxidation-reaction rate of the precursor fibers. The contact time of the precursor per contact ranges from about 0.1 to about 3 seconds. In order to raise the cooling efficiency of the cooling means, a refrigeration medium is forcibly circulated inside the cooling means.

DRAWINGS

DESCRIPTION

Figure 1:
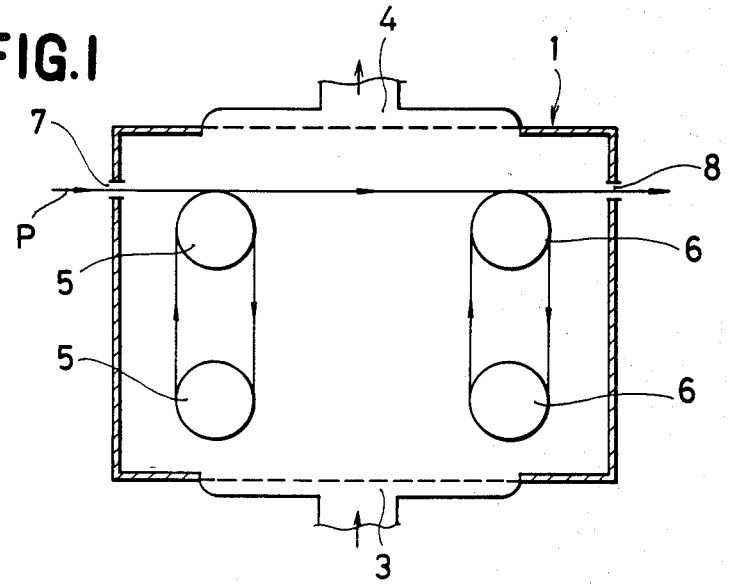
FIG. 1 is a schematic sectional view of an oxidative furnace used in one embodiment of the present invention taken on the plane in the precursor's travel path.

As the precursor to be used in the present invention, any of the polymer fibers such as acrylic fibers and polyvinyl alcohol fibers, pitch fibers, cellulose fibers, etc. can be used. Of these, acrylic fibers are preferable, because they easily provide carbon fibers having high elongation, high strength, and high modulus.

The oxidative atmosphere of at an elevated temperature for converting the precursor to oxidized fibers is the same as in a conventional process; that is, a furnace is used in which air heated to 240° to 400° C. is circulated. Cooling means cooled by a refrigeration medium are disposed in this furnace, and the precursor is intermittently and repeatedly contacted with the cooling means.

When heated in the 240° to 400° C. oxidative atmosphere, the precursor undergoes an exothermic oxidation reaction, and the generated heat is accumulated in the precursor, resulting in an increase of the temperature of the precursor. Therefore, if the temperature of the oxidative atmosphere is too high or if the rate of temperature increase is too rapid, there results formation of a tarry product or adhesion of single filaments and, in the worst case, breakage or combustion of the filaments.

In the present invention, the precursor is intermittently brought into contact with cooling means to intermittently cool the precursor while it is heated in the high-temperature oxidative atmosphere. Therefore, the temperature of the precursor itself is controlled so that it does not increase abnormally whie it is heated in the high-temperature oxidative atmosphere. Thus, the temperature of the oxidative atmosphere can be set at a higher level, whereby the oxidation step can be accelerated while at the same time preventing formation of pitch and tarry products and adhesion of single filaments to each other. Since formation of pitch and tarry products and adhesion of single filaments to each other are suppressed, the resulting oxidized fibers can be converted to carbon fibers with high performance characteristics.

The temperature of the precursor in contact with the cooling roller is preferably controlled to be about 5° to about 30° C. lower than its temperature before being brought into contact with the cooling means. By lowering the temperature to this range and controlling the oxidation reaction rate of the precursor, improved prevention of accumulation of heat in the precursor can be obtained as well as suppression of adhesion of single filaments to each other and of non-uniform oxidation reaction. The contact time during which the precursor is brought into contact with the cooling means is controlled to be about 0.1 to about 3 seconds per contact. If the contact time is shorter than about 0.1 second, there results insufficient cooling effect and, if longer than 3 seconds, there results less efficiency in raising the temperature of the precursor in the oxidative atmosphere, leading to reduction in thermal efficiency.

A tarry product formed in the oxidation process of the precursor deposits and accumulates on the cooling means to inhibit cooling action of the cooling bodies and cause breaking of single filaments of the precursor. In order to reduce the amount of tarry product deposited on the cooling means, it is beneficial to subject the precursor to a preliminary heat treatment prior to the oxidation treatment, thereby reducing the amount of formed tarry product to 5% or less. The phrase "amount of formed tarry product" as used herein means the difference in amount between the precursor before the heat treatment for 5 minutes in a 250° C. oxidative atmosphere and the precursor after the treatment, presented as wt %.

The preliminary heat treatment for controlling the amount of formed tarry product to 5 % or less can be easily conducted by bringing the precursor into contact with the surface at a temperature of 150° to 240° C. of a heating medium for 2 to 120 seconds prior to supplying it to the oxidative step. Of course, the preliminary heat treatment may be conducted in a different manner.

Figure 2:
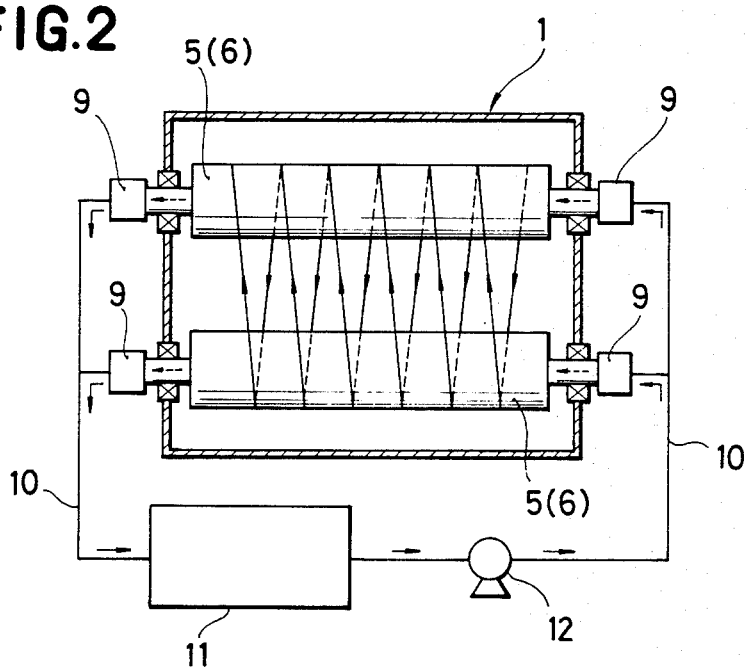
FIG. 2 is a schematic sectional view of the above-described furnace taken on the plane at a right angle with the precursor's travel path.

FIGS. 1 and 2 show an oxidation furnace for converting a precursor to oxidized fibers. This furnace 1 has an inlet 3 and outlet 4 for a heating air which is to be introduced into the furnace to form an oxidative atmosphere. The heating air is further circulated to be kept at 240° to 400° C. in the furnace.

Cooling bodies 5, 5 and 6, 6 composed of a pair of Nelson rollers are juxtaposed. Precursor P introduced into the furnace via inlet 7 is wound around the first cooling rollers 5, 5 plural times to repeatedly undergo intermittent cooling, then again wound around the next cooling rollers 6, 6 to similarly undergo repeated intermittent cooling, and comes out of the furnace via outlet 8. The precursor is preferably wound several ten times or more around each roller pair. Such intermittent repeated contact of precursor P with cooling rollers 5 and 6 is conducted for about 0.1 to 3 seconds per contact as described hereinbefore. As a result, the temperature of precursor P itself is controlled to drop about 5° to about 30° C. from the temperature before the contact.

Each pair of cooling rollers 5 and 6 has a refrigeration medium-circulating path formed therein, and rotary joints 9 are connected to both axis ends. These rotary joints 9, 9 are also connected to refrigeration medium tank 11 and circulating pump via circulating pipe 10. The refrigeration medium in tank 11 is forcibly delivered by circulating pump 12 so as to travel through the path formed within cooling rollers 5 and 6 and control the surface temperature of the rollers to keep it close to a predetermined temperature. The temperature of the refrigeration medium is controlled to be ±2° C. in the tank 11. The cooling rollers preferably have a temperature distribution in a longitudinal direction that is controlled within ±3° C. by the circulation of the refrigeration medium. This control can be effected by, for example, controlling the flow rate of the refrigeration medium to be circulated through the rollers.

Since the cooling rollers in the furnace also function to convey the precursor, they eliminate the necessity of providing additional conveying rollers. However, in the present invention additional conveying rollers may be provided, if necessary.

The cooling means used in the oxidation process of the present invention may consist of plates, pipes or the equivalent, and the cooling means may be used alone or in combination. However, when the fibers are filaments or tows, a roll is preferable in regard to process efficiency.

The oxidized fibers obtained by heat-treating a precursor in an oxidative atmosphere in the above-described manner are then heated in an inert gas atmosphere of at least 800° C. such as a nitrogen gas to carbonize. This carbonization can yield carbon fibers with high performance characteristics.

As is described above, according to the process of the present invention for producing carbon fibers, the temperature of the oxidative atmosphere in the oxidative step can be set at a higher level without formation of a tarry product, adhesion of single filaments to each other, and non-uniform oxidation, because the temperature of the precursor itself is controlled by concurrently conducting intermittent instant cooling to thereby prevent accumulation of heat in the precursor. Therefore, the time required for the oxidation step is shortened and productivity is enchanced, and yet carbon fibers with high performance can be obtained.

In addition, the process of the present invention enables the production of oxidized fibers with high energy efficiency by facilitating control of the temperature of the precursor itself in the oxidative atmosphere.

The present invention will now be described in more detail by reference to the following examples of preferred embodiments of the present invention.

EXAMPLE 1

6,000 Denier, 6,000-filament acrylic fiber yarn was baked for 18 minutes in a circulating hot air furnace in which two pairs of 200 mmϕ cooling rollers were disposed as guide rollers for conveying the yarn and which was kept at 260° C. The surface temperature of the cooling rollers was set to 250° C., the contact time of the yarn with the cooling roller was controlled to 1.9 seconds per contact, and the total contact number was controlled to 130. In addition, the precursor traveled within the furnace at a speed of 10 m/min. Tensile strength, elongation, equilibrium moisture content, fluffing state, and degree of adhesion between single filaments of the thus obtained oxidized fibers are shown in Table 1.

Then, the oxidized fibers were heated in a 1,250° C. nitrogen atmosphere to carbonize. Thus, carbon fibers were obtained.

Physical properties of the resulting carbon fibers are also shown in Table 1.

TABLE 1

| | | |
|---|---|---|
| Physical properties of oxidized fibers | Tensile strength (g/d) | 3.0 |
| | Elongation (%) | 10.1 |
| | Number of fluffs (per m) | 2 |
| | Degree of welding | no |
| | Equilibrium moisture content (%) | 6.5 |
| Physical properties of carbon fibers | Tensile strength (kg/mm$^2$) | 404 |
| | Elongation (%) | 1.67 |
| | Modulus (t/mm$^2$) | 24.2 |

EXAMPLE 2

Precursor fibers were oxidized and carbonized in the same manner as in Example 1 except for changes in the migration speed of the precursor within the furnace and changes in the contact time of the precursor with the cooling roller as shown in Table 2. Physical properties of the resulting oxidized fibers and carbon fibers are shown in Table 2.

TABLE 2

| Roller-contacting Time sec/contact | Treating Temp. (°C.) | Treating Time (min) | Properties of Oxidized Fibers: Equilibrium Moisture Content (%) | Strength/Elongation (g/d/%) | Number of Fluffs (per m) | Welding | Properties of Carbon Fibers: Strength (kg/mm²) | Young's Modulus (ton/mm²) | Elongation (%) |
|---|---|---|---|---|---|---|---|---|---|
| 0.5 | atmosphere: 260; roller: 250 | 18 | 7.5 | 2.6/8.8 | 8 | good | 402 | 23.9 | 1.68 |
| 1.0 | atmosphere: 260; roller: 250 | " | 5.8 | 3.0/10.1 | 3 | good | 420 | 24.1 | 1.74 |
| 3.0 | atmosphere: 260; roller: 250 | " | 5.2 | 3.1/9.2 | 10 | fair | 418 | 24.2 | 1.73 |
| 5.0 | atmosphere: 260; roller: 250 | " | 3.8 | 4.0/11.0 | 25 | bad | 220 | 21.5 | 1.02 |
| 0.1 | atmosphere: 260; roller: 250 | " | 8.5 | 2.3/6.0 | 20 | good | 371 | 24.0 | 1.56 |

EXAMPLE 3

When the same procedure as described in Example 1 was repeated except that the precursor was heated continuously over 50 hours in a circulating hot air furnace to bake it, a tarry product was found to deposit on the surface of the cooling rollers, and staining of the resulting oxidized fibers and fluffing were observed.

Accordingly, the baking procedure was once discontinued, and the cooling rollers and the inside of the furnace were cleaned. Then, fiber yarns having been previously brought into contact with heat-treating rollers with a surface temperature of 240° C. for 2 minutes which resulted in 2% contraction and an amount of formed tar of 3.1% were similarly continuously rendered flame-resistant in the clean furnace. Thus, it was possible for this procedure to be continuously carried out for 30 days. Oxidized fibers and carbon fibers obtained after a 30-day baking run had the physical properties shown in Table 3.

TABLE 3

| | | |
|---|---|---|
| Physical properties of oxidized fibers | Tensile strength (g/d) | 3.2 |
| | Elongation (%) | 9.6 |
| | Number of fluffs (per m) | 1 |
| | Equilibrium moisture content (%) | 6.7 |
| Physical properties of carbon fibers | Tensile strength (kg/mm²) | 398 |
| | Elongation (%) | 1.65 |
| | Modulus (t/mm²) | 24.1 |

COMPARATIVE EXAMPLE 1

When the same oxidation procedure as described in Example 1 was repeated except that the rollers were not cooled and wer isolated by partition walls and a 250° C. air was circulated in the partitioned zone to cool the precursor, the surface temperature of the rollers reached 265° C. due to accumulation of heat about 15 minutes after initiation of heating. Therefore, the temperature of the cooling air was controlled to adjust the temperature of the partitioned zone to 245° C. for keeping the roller surface temperature to 260° C. or less. As a result, the precursor could not be well oxidized by the heat treatment conducted for about 18 minutes, and oxidized fibers not burnt by the flame of a match were obtained only when the heating was continued for 33 minutes. In addition, the resulting oxidized fibers and the carbon fibers had unsatisfactory physical properties as shown in Table 4.

TABLE 4

| | | |
|---|---|---|
| Physical properties of oxidized fibers | Tensile strength (g/d) | 3.1 |
| | Elongation (%) | 10.8 |
| | Equilibrium moisture content (%) | 4.2 |
| Physical properties of carbon fibers | Tensile strength (kg/mm²) | 270 |
| | Elongation (%) | 1.19 |
| | Modulus (t/mm²) | 22.6 |

We claim:

1. A process for producing carbonizable oxidized fibers, which comprises oxidizing precursor fibers in an oxidizing atmosphere containing an oxidizing gas heated to about 240° to 400° C. by intermittently contacting and removing said precursor fibers on and from a cooling means positioned inside said oxidizing atmosphere, wherein the contact time per single contact of said precursor fibers with the cooling means is from about 0.1 to about 3 seconds, and the temperature drop caused by said contact is about 5° to about 30° C.

2. The process for producing carbonizable oxidized fibers as recited in claim 1, wherein said cooling means is cooled with a refrigeration medium circulated therein.

3. The process for producing carbonizable oxidized fibers as recited in claim 1, wherein the cooling means is a roller.

4. The process for producing carbonizable oxidized fibers as recited in claim 1, wherein the cooling means is a plate.

5. The process for producing carbonizable oxidized fibers as recited in claim 1, wherein the cooling means is a pipe.

6. The process for producing carbonizable oxidized fibers are recited in claim 1, wherein the precursor fibers have previously been subjected to preliminary heat treatment prior to being oxidizing in the oxidative atmosphere to thereby reduce the amount of formed tarry product to about 5% by weight or less.

7. The process for producing carbonizable oxidized fibers as recited in claim 5, wherein the preliminary heat treatment of the precursor fibers is conducted by contacting them with heating rollers of 150° to 240° C.

8. The process for producing carbonizable oxidized fibers as recited in claim 1, wherein said precursor fibers are continuous fibers selected from the group consisting of acrylic fibers, polyvinyl alcohol fibers, pitch fibers, and cellulose fibers.

9. A process for producing carbon fibers, which comprises:

(a) providing a cooling means positioned inside a 240° to 400° C. oxidative atmosphere, (b) heating a precursor composed of continuous filaments in said oxidative atmosphere to thereby convert the precursor to oxidized fibers, while intermittently and repeatedly bringing the precursor into contact with the cooling means, for a contact time of about 0.1 to about 3 seconds which causes a temperature drop in the precursor of about 5° to about 3° C., and (c) carbonizing the resulting oxidized fibers in an inert atmosphere of at least 800° C.

10. The process for producing carbon fibers as recited in claim 9, wherein said cooling means is cooled with a refrigeration medium circulated therein.

11. The process for producing carbonizable oxidized fibers as recited in claim 9, wherein the cooling means is a roller.

12. The process for producing carbonizable oxidized fibers as recited in claim 9, wherein the cooling means is a plate.

13. The process for producing carbonizable oxidized fibers as recited in claim 9, wherein the cooling body is a pipe.

14. The process for producing carbon fibers as recited in claim 9, wherein the precursor has previously been subjected to preliminary heat treatment prior to heating in the oxidative atmosphere to thereby reduce the amount of formed tarry product to about 5% or less.

15. The process for producing carbon fibers as recited in claim 14, wherein the preliminary heat treatment of the precursor is conducted by contacting it with heating rollers of 150° to 240° C. in an oxidative atmosphere.

16. The process for producing carbon fibers as recited in claim 4, wherein said precursor is continuous fibers selected from the group consisting of acrylic fibers, polyvinyl alcohol fibers, pitch fibers, and cellulose fibers.

17. The process for producing carbonizable oxidized fibers as recited in claim 1, wherein said cooling means are two pairs of cooling rollers, and said precursor fibers are wound at least ten times around each pair of cooling rollers.

18. The process for producing carbon fibers as recited in claim 9, wherein said cooling means are two pairs of cooling rollers, and said precursor fibers are wound at least ten times around each pair of cooling rollers.

* * * * *